US006290618B1

(12) United States Patent
Ring

(10) Patent No.: US 6,290,618 B1
(45) Date of Patent: Sep. 18, 2001

(54) PORTABLE BALL BATTING PRACTICE APPARATUS

(76) Inventor: David Lee Ring, 9955 Pibroch La., Wilton, CA (US) 95693

( * ) Notice: Subject to any disclaimer, the term of this patent is extended or adjusted under 35 U.S.C. 154(b) by 0 days.

(21) Appl. No.: 09/469,759

(22) Filed: Dec. 22, 1999

(51) Int. Cl.[7] ..... A63B 69/00
(52) U.S. Cl. ..... 473/429; 473/422
(58) Field of Search ..... 473/415–417, 473/423–424, 427, 429, 419, 430, 453

(56) References Cited

U.S. PATENT DOCUMENTS 2,976,040 * 3/1961 Bales ..... 473/429
4,793,612 * 12/1988 Hammond ..... 473/429
5,273,277 * 12/1993 Freese ..... 473/429
5,454,561 * 10/1995 Smith ..... 473/429
5,472,186 * 12/1995 Paulsen ..... 473/429
5,743,820 * 4/1998 Espinosa et al. ..... 473/429
5,755,630 * 5/1998 Malwitz ..... 473/429
5,803,836 * 9/1998 Beintema ..... 473/429

* cited by examiner

*Primary Examiner*—Jeanette Chapman
*Assistant Examiner*—Mitra Aryanpour
(74) *Attorney, Agent, or Firm*—James M. Ritchey

(57) ABSTRACT

A portable ball batting practice apparatus for attachment to a pre-existing support includes an elongated member having two ends. The elongated member is attached at one of its ends, via a rotational hub assembly, to one end of a two-ended rotatable arm. The other end of the rotatable arm is secured to a ball. By employing opposing stops within the rotational hub assembly, the rotational hub assembly allows both right and left handed hitters to utilize the apparatus and produces a directed "pitch" for a user to hit. Incorporated into the elongated member is a releasable anchoring system for attaching the elongated member to the support.

5 Claims, 5 Drawing Sheets

PORTABLE BALL BATTING PRACTICE APPARATUS

BACKGROUND OF THE INVENTION

1. Field of the Invention

A training apparatus for assisting a user in developing ball batting skills is provided and may be utilized by either right or left handed batters. More particularly, the apparatus releasable secures to an existing support and includes an arm member having a ball that is attached to the arm by a rotational means that supplies to the user a moving ball to hit.

2. Description of the Background Art

Several related devices have been found in the prior art that comprise ball hitting trainers. However, most of these devices are rather complex structurally and incorporate self supporting elements or do not provide a moving pitch to hit. One such device merely supplies a ball tethered by a freely rotating pivot joint to the end of a horizontal support. The energy imparted to the ball by the hit is dispatched in spinning the ball in a constant radius circle about the pivot joint and no return pitch is delivered.

More particularly, described in U.S. Pat. No. 2,058,277 is a baseball practice machine that includes a motor-driven rotating arm. Connected to the rotating arm is a rubber cord fastened to a ball. Hitting the ball merely extends the cord for a period of time.

A practice tether ball device is presented in U.S. Pat. No. 2,976,040. A flexible cable is affixed to a rotating hub. Upon hitting the ball the ball and cord spin about the hub until the imparted energy is dissipated.

Supplied in U.S. Pat. No. 3,425,700 is a golf practice device having a vertical support and a downwardly angle arm to which a tether and ball are connected. Hitting the golf ball produces a free rotation of the tether and ball about the tether to arm connection point.

Disclosed in U.S. Pat. No. 3,626,502 is a tethered ball for baseball batting practice. Comprising the device is a stake having an internal spring that is fastened to one end of a tether. A ball is fastened to the other end of the tether.

U.S. Pat. No. 3,652,088 discloses a tethered ball baseball batting practice device. A tethered ball is slidably engaged with an upwardly sloping cable. When the ball is hit it slides up the cable until the imparted energy is spent and then slides back down into an initial position.

A training device including a captive ball to be struck by a game club is specified in U.S. Pat. No. 3,731,926. A ball is fastened to a spring return mechanism. Upon hitting the ball the ball deflects and is repositioned in the initial location by the spring return mechanism.

U.S. Pat. No. 3,994,494 relates a tethered ball baseball practice having a tethered ball that deflects into a net upon hitting. After the energy of the hit is absorbed in the net, the ball returns to hang in its initial position.

U.S. Pat. No. 4,451,036 reports a batting practice device that holds a ball in a releasable position for hitting. Upon hitting the ball the ball is projected from within the held position and forward. The ball is not tethered to the device.

Related in U.S. Pat. No. 4,815,735 is a pitching machine having a tethered ball that is secured to a horizontal arm that is part rigid and part semi-rigid. The arm is attached to a vertical support member. A motion damping mechanism is included.

A sports training device is presented in U.S. Pat. No. 4,647,042. A weighted base member extends into an adjustable vertical support. Attached to the top of the vertical support is a horizontal arm that terminates in a tether that is secured to a ball.

U.S. Pat. No. 4,872,675 describes a baseball pitching device having a base support and a rotating arm attached to the base. The arm has a tethered ball anchored to one end and a counter weight at the other end. Means are supplied for rotating the arm relative to the base support to produce a moving ball to strike.

Disclosed in U.S. Pat. No. 4,964,634 is a tethered ball batting practice device comprising a ball secured to a two-part tether having a cord section and a resilient section. The end of the resilient section is mated to a stake that has a backup anchor.

A tethered ball batting practice device is presented in U.S. Pat. No. 5,000,450. A ball is tethered to a freely rotating hub. The hub is secured to an arm which is releasably fastened to a vertical support. Hitting the ball produces rotation about the hub until the energy is spent.

U.S. Pat. No. 5,056,781 discloses a tethered ball pitching apparatus including an elastic cord anchored to a ball. The cord is attached to an elevated bracket. The device is positioned between a batter and a pitcher.

U.S. Pat. No. 5,271,618 communicates a batting practice device having a tethered ball that is attached to a rotating hub. The hub is connected to a bracket that anchors to a fence of other equivalent support. Hitting the ball produces free rotation of the ball and tether about the hub.

Described in U.S. Pat. No. 5,460,364, issued to the subject inventor Ring, is a portable ball batting practice apparatus that comprises many of the current invention's elements except that no fixed-length tether is utilized to limit the amount of energy stored after hitting the ball in the wrapping of the resilient tether around the elongated member. Although the device related in U.S. Pat. No. 5,460,364 is a very useful practice apparatus, the introduction of the critical fixed-length tether greatly improves usage of the subject device.

Another device patented by the subject inventor, Ring, is related in U.S. Pat. No. 5,683,315. This device is again a portable ball batting practice apparatus that is somewhat related to the invention disclosed in U.S. Pat. No. 5,460,364, except the newer device introduced a critical fixed-length, but flexible tether, thus producing a two-tether apparatus, that greatly improved usage of the earlier version.

SUMMARY OF THE INVENTION

An object of the present invention is to provide an inexpensive, easily transported, and easy to set up ball batting practice apparatus that minimizes potential risks of injury during usage.

Another object of the present invention is to disclose a ball batting practice apparatus that includes a ball affixed by a rotation arm that is secured to a support member via a hub assembly that produces a pitch motion for the ball when the original hit slows sufficiently.

Still another object of the present invention is to make known a ball batting practice apparatus that provides a moving target to hit and that may be utilized by either right or left handed hitters.

Yet a further object of the present invention is to supply a ball batting practice apparatus that utilizes the force the batter exerts to energize the apparatus for the next pitch and therefore requires no electricity or other outside energy source to deliver a pitch-like target ball to a hitter.

Yet another object of the present invention is to provide a ball batting practice apparatus that includes means for generating a pitch when sufficient original hit-induced rotational momentum is lost.

Still yet another object of the present invention is to disclose a ball batting practice apparatus that is easily supported by pre-existing supports that are found at standard ball practice areas.

Still a further object of the subject invention is to make it easy for one person to operate and obtain many pitches in a short amount of time without the necessity of a new setup before each pitch.

Disclosed is a portable ball batting apparatus for attachment to a pre-existing support. The subject apparatus comprises an essentially hollow elongated member having first and second ends and an interior space. A support means is attached to the elongated member second end. A rotatable arm having first and second ends is attached by the rotatable arm's first end to the elongated member by rotational means, usually a hub assembly having at least a pair of opposing stops, and a ball is secured to the rotatable arm's second end. Preferably, the rotational means comprises a hub assembly that includes first and second stops. After the ball is hit by the user, the rotatable arm pivot about the elongated member at the hub assembly until rotational motion decrease to a point that the first and second stops hit one another, thereby reversing the motion of the ball and delivering a "pitch" to the user. Many acceptable anchoring means are contemplated. One possible support mechanism utilizes a post that is releasably secured between a support contacting plate and an anchoring bolt. Frequently, the support contacting plate may have a resilient surface coating that contacts the support for added frictional interaction and minimizing possible damage to the pre-existing support.

Other objects, advantages, and novel features of the present invention will become apparent from the detailed description that follows, when considered in conjunction with the associated drawings.

DESCRIPTION OF THE PREFERRED EMBODIMENT

Referring now to FIGS. 1–6, there is shown a preferred embodiment of a portable ball batting practice apparatus that attaches to a support S. Usually, the support S is a vertical or horizontal fence post or similar structure that is found in a pre-existing form at a ball practice location and is not, usually, built or installed for each practice session with the subject invention. Most ball practice areas have vertical fence posts or backstop supports that are ideal attachment sites for the subject apparatus. Since vertical fence posts are often about three feet to about six feet in height or greater and backstop supports are generally about eight feet or greater, the subject device can be anchored at any desired height for a user.

Figure 1:
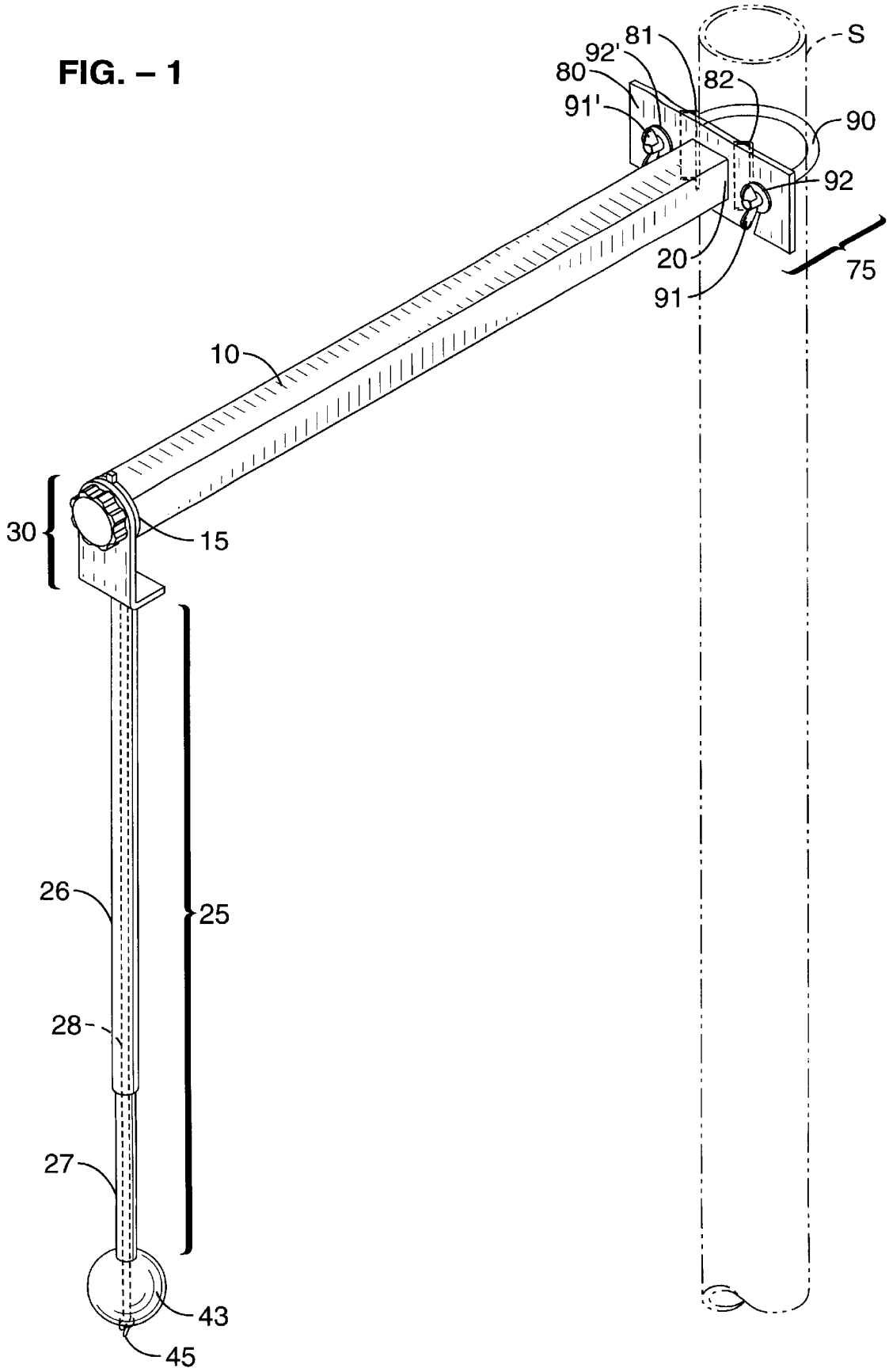
FIG. 1 is a perspective view of the subject invention showing temporary attachment to a support.
Figure 2:
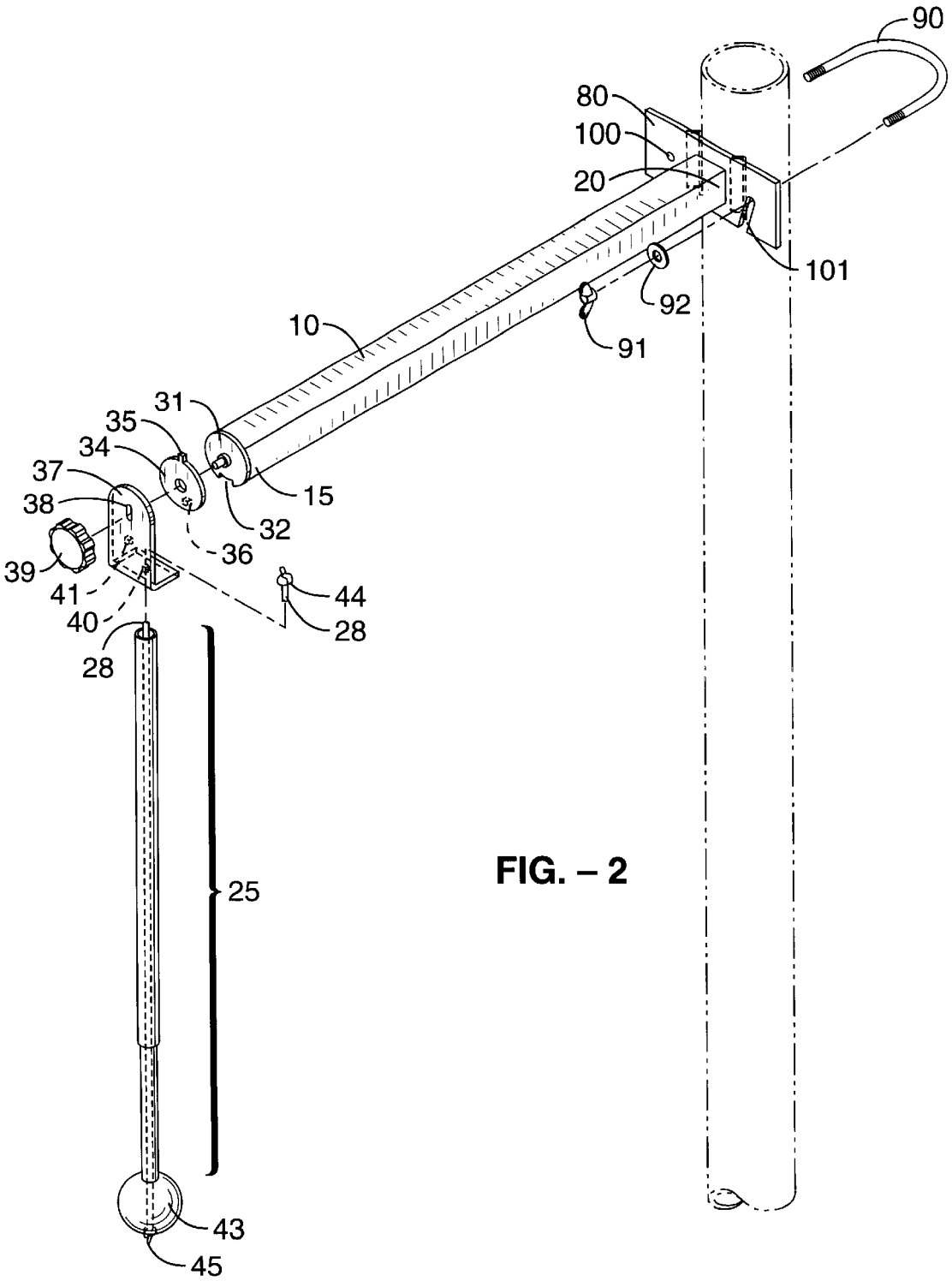
FIG. 2 is an exploded view of the subject invention.

As illustrated in FIGS. 1 and 2, a support component is present and is an elongated and usually hollow member 10 that serves as a central framework structural element for the subject apparatus. Normally, the elongated member 10 is fabricated from materials such as metal or natural or synthetic polymeric substances and is formed with any suitable cross-sectional profile such as square (shown in FIGS. 1 and 2), rectangular, circular, triangular, or other equivalent shape. Usually, the elongated member 10 is rigid or semi-rigid, The elongated member 10 has first 15 and second 20 ends and, as mentioned above, is usually at least partially hollow with an interior space (not shown).

As seen in particular in FIG. 1, a rotational arm 25 is secured at one end to the elongated member 10 first end 15 via a hub assembly 30. The other end of the rotational arm 25 is connected by its other end to a ball 43. Often, the rotational arm 25 comprises a hollow member that may have one or more segments (see FIG. 1 in which the rotational arm 25 is composed of first 26 and second 27 members that may telescope to minimize storage space). The rotational arm 25 may be fabricated from flexible to semi-rigid to rigid materials, but is usually formed from semi-rigid substances such as suitable natural or synthetic polymers. The rotational arm 25 is rigidly attached to the hub assembly 30 at the hub bracket 37. As illustrated in FIGS. 1 and 2, the tether 28 extends the length of the rotatable arm 25 and is secured at one end to the ball 43 and at the other end to the hub assembly 30. Commonly, the tether 28 is secured by a simple knot 44 and 45 at each end. Other equivalent means for securing the tether 28 are well within the realm of this disclosure. It must be remembered that the rotational arm 25 may be configured in many equivalent ways such as: a structurally continuous member that includes either or both the hub assembly, or a portion thereof, and a ball; a multiple-part assembly that may be disassembled for storage or transportation; a structure lacking the central tether 28 and directly attached to the hub assembly 30 and ball 43; and the like.

Figure 3:
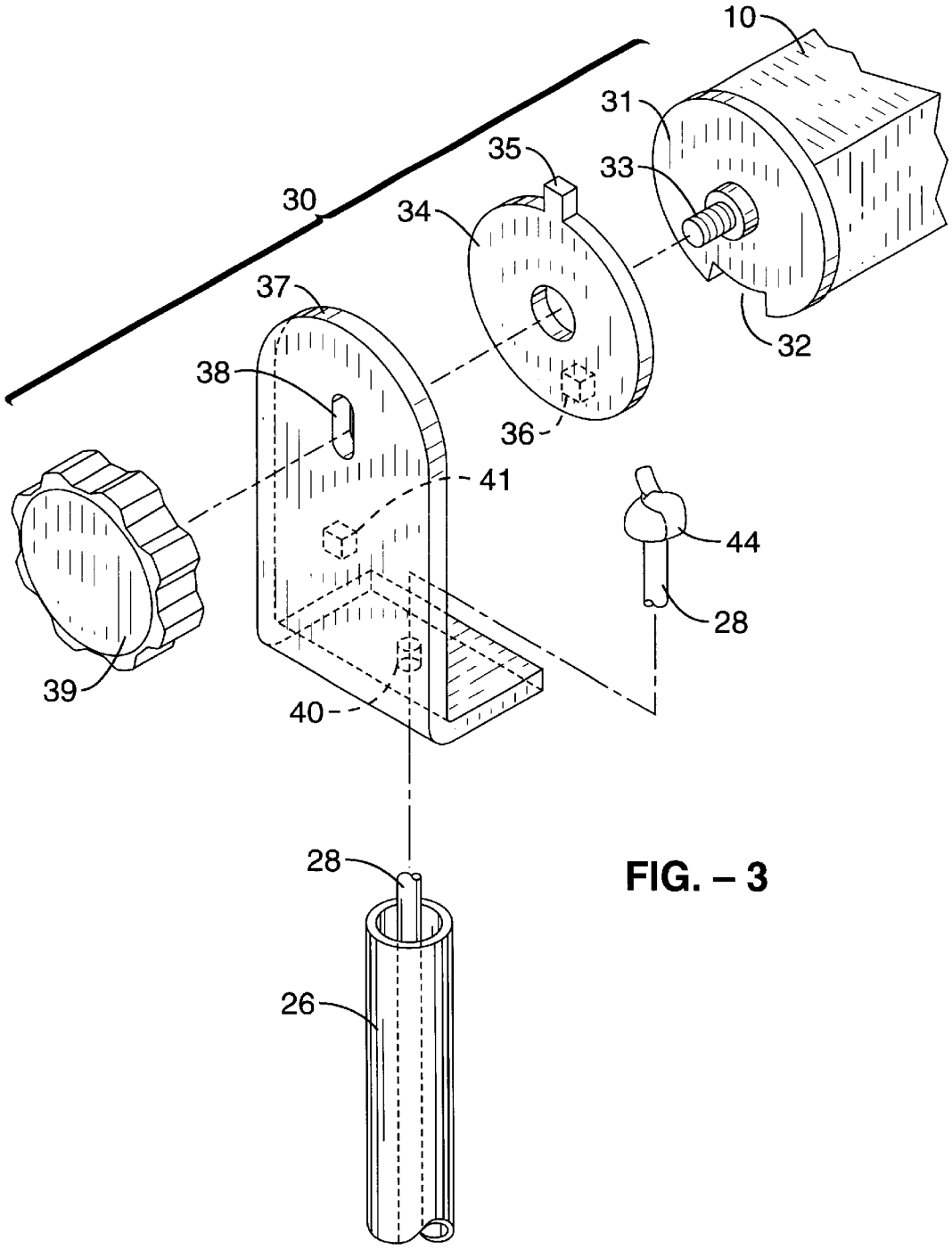
FIG. 3 is an exploded view of the hub assembly of the present invention.

As seen in detail in FIG. 3, the hub assembly 30 comprises mounting plate 31 secured by standard techniques (such as welding, molding, and the like) to the elongated member's first end 15. The mounting plate 31 has a notch 32 in its perimeter. Attached to and extending away from the mounting plate 31 is an axle element 33. The axle element 33 is usually at least partially threaded.

A stopper washer 34 fits around or about the axle element 33 and includes a first stop 35 that usually projects away from its outer perimeter, although other equivalent variations are within the realm of this disclosure and a limiting stop 36 which, when correctly assembled with the mounting plate 31, fits within notch 32. The combination of limiting stop 36 and the notch 32 allow the subject device to be utilized by either right or left handed hitters.

A hub bracket 37 fits over the axle element 33 via an oval or elongated aperture 38. The hub bracket 37 usually has a generally "L" shaped configuration. Means for securing or retaining the hub bracket 37 to the axle element 33 is provided and is usually a retention nut 39 that is generally threaded to permit the user to tighten and loosen it with fingers only (no extra tool required) to the axle element 33. Other equivalent attachment methods between the retention means and the axle element are possible such as bayonet means, snap means, and the like.

The hub bracket 37 has an attachment region for securing the rotational arm 25, usually to the foot of the "L" configuration by a rigid weld or equivalent attachment. Generally, the attachment region is a foot portion of the "L" shaped hub bracket 37 that contains an aperture 40 through which the tether 28 extends and is secured via the knot 44.

Figure 4:
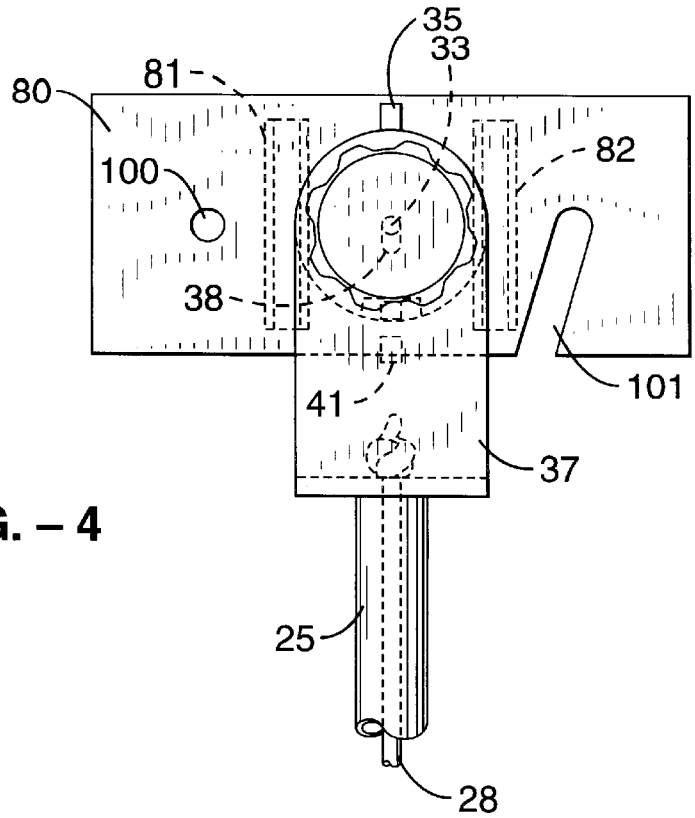
FIG. 4 is a partial end view of the subject invention detailing the hub assembly with its associate stops and showing the rotational arm at rest.
Figure 5:
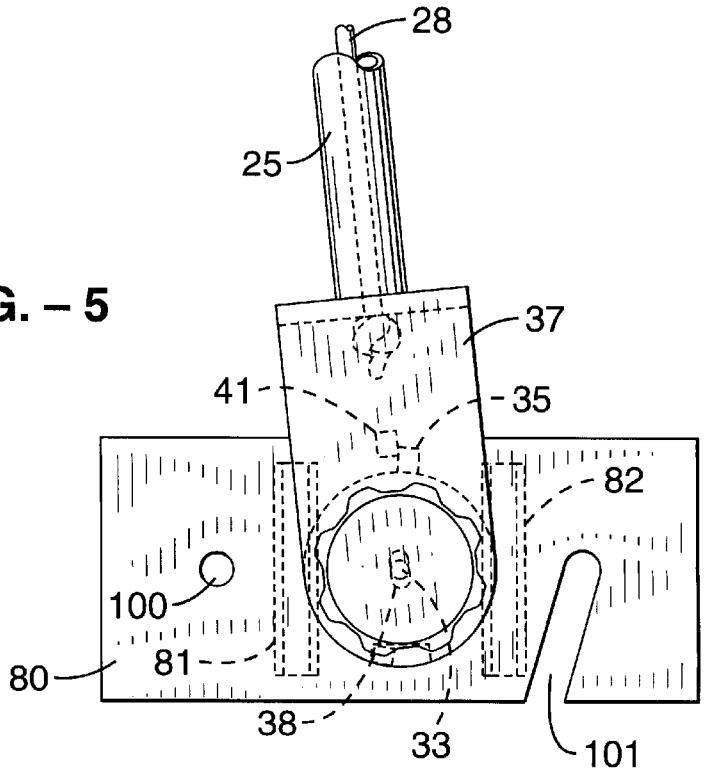
FIG. 5 is a partial end view of the subject invention detailing the hub assembly with its associate stops and showing the rotational arm after rotational energy from a hit has been dissipated with the stops contacting one another and reverse motion of the rotational arm is about to start for delivery of a pitch.

A second stop 41 projects away from the side of the hub bracket 37 that faces the stopper washer 34 and mounting plate 31. Together, stops 35 and 41 and the elongated or oval aperture 38 primarily comprise the rotation reversal means of the subject invention. When the movable portions of the hub assembly 30 spin with sufficient momentum to keep the axle element 33 forced against one end of the elongated aperture 38 after a hit by the user, the two stops 35 and 41 do not contact one another. However, FIGS. 4 and 5 illustrate the critical role or function of the hub assembly 30 is allowing rotation of the arm 25, stopping rotation of the arm 25, and delivering a pitch to the user for a subsequent hit. Specifically, FIG. 4 depicts the hub assembly 30 and arm 25 of the subject device immediately before being hit by a user. In this "before-the-hit" situation, the arm 25 hangs at rest (or is moving towards the hitter if the ball 43 was previously hit). In this position the stops 35 and 41 are not able to contact one another. FIG. 5 shows the hub assembly 30 and arm 25 of the subject device after the user (right handed in the depicted case) hits the ball 43 and the resultant rotational motion of the arm 25 has slowed to the point at which the outward rotational or centripetal force has decreased enough to allow the arm 25, when in the approximately vertical position above the hub assembly 30 to drop sufficiently (due to gravitational forces and slippage of the axle element 33 down into the lower portion of the oval or elongated aperture 38) for the stops 35 and 41 to hit each other (thus, stopping motion in the original hit-induced direction) and initiate motion in the reverse direction for the forward pitch. Clearly, the retention nut 39 must be fitted to the axle element 33 in a sufficiently loose configuration to permit the downward slippage and rotation, but tight enough to not permit the stops 35 and 41 to pass one another when a "stop" is desired to begin the reverse motion.

Slippage of limiting stop 36 within notch 32 align the first stop 35 in a position that shifts and thus stops rotation for either a right or left handed hitter when the second stop 41 encounters first stop 36.

Figure 6:
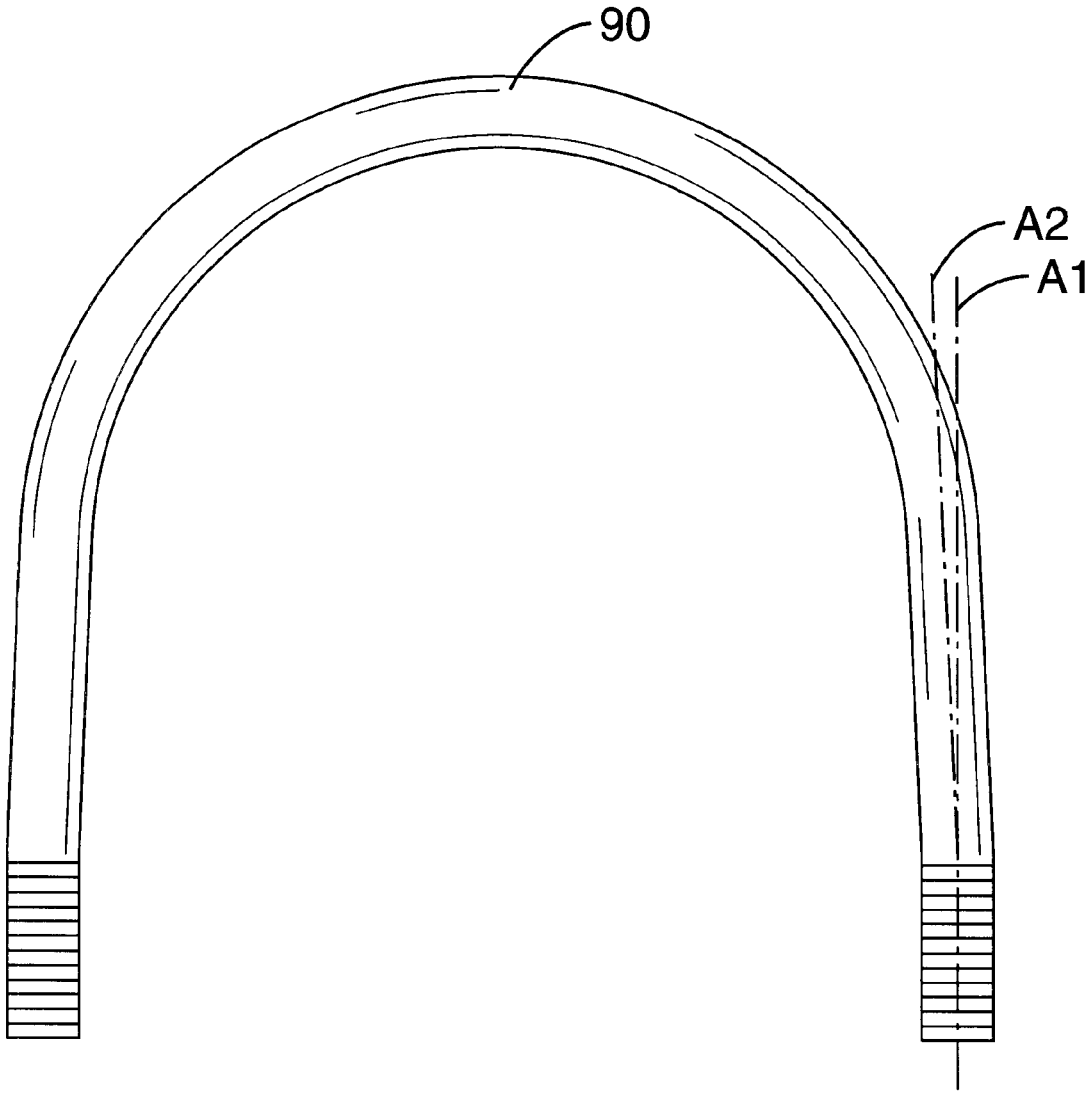
FIG. 6 is a planar view of the anchoring bolt of the subject invention.

Means for anchoring the elongated member 10 to the support S are provided. Various anchoring means are possible for the subject device such as clamps, straps with come-alongs or ratchets, hooks, and the like. A preferable means for anchoring the subject device is the one shown in the figures. In particular, FIGS. 1 and 2 illustrate the anchoring means as a bracket assembly 75 comprised of a mounting member 80 having alignment rails 81 and 82 and a generally U-shaped anchoring bolt 90 with two threaded ends. As seen in FIG. 6, the generally U-shaped anchoring bolt 90 is usually slightly distorted, from axis A1 to axis A2, to facilitate mounting around a vertical pole with the attachment wing nuts 91 and 91' still on, but this axis distortion is not required, just handy for quick installation purposes. The anchoring bolt 90 is easily and releasably attached to the mounting element 80 via means such as the wing nuts 91 and 91', washers 92 and 92', and a first receiving aperture 100 and second receiving aperture or usually a slot 101 (the receiving slot 101 permits rotation to release the anchoring bolt 90 for easy installation about a vertical pole). Again, clearly, different equivalent and suitable means other than the presented threaded elements can be utilized to secure the subject device to a support S. Also, the surfaces of the mounting element 80 and anchoring bolt 90 that contact the support S may be covered or coated with protective materials to prevent damage to the support S.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A portable ball batting practice apparatus for attachment to a support, comprising:

a) an elongated member having first and second ends;

b) a rotatable arm having first and second ends, wherein said rotatable arm's first end is secured to said elongated member's first end by rotational means;

c) said rotational means for connecting said rotatable arm to said elongated member, wherein said rotational means comprises:

i) a hub assembly, wherein said hub assembly comprises:

a mounting plate attached to said elongated member first end;

an axle element projecting from said mounting plate;

a stopper washer having an aperture that receives said axle element;

a hub bracket having an elongated aperture wherein said axle element extends through said elongated aperture and said rotatable arm's first end is secured to said hub bracket; and retention means for securing said hub bracket to said axle element and ii) a ball motion reversal means as a component said hub assembly;

d) a ball secured to said rotatable arm second end; and e) means associated with said elonaated member second end for anchoring said elongated member to the support.

2. A portable ball batting practice apparatus according to claim 1, wherein said ball motion reversal means comprises:

a) said hub bracket with said elongated aperture;

b) a first stop associated with said stopping washer; and c) a second stop associated with said hub bracket.

3. A portable ball batting practice apparatus according to claim 1, wherein said anchoring means comprises:

a) a bracket assembly comprising:

i) a mounting element with first and second apertures and ii) alignment rails and b) a generally U-shaped anchoring bolt with two threaded ends wherein each of said two threaded ends fits with one of said first and second apertures.

4. A portable ball batting practice apparatus for attachment to a support, comprising:

a) an elongated member having first and second ends;

b) a rotatable arm having first and second ends, wherein said rotatable arm's first end is secured to said elongated member's first end by rotational means;

c) said rotational means for connecting said rotatable arm to said elongated member, wherein said rotational means comprises:

i) a hub assembly, wherein said hub assembly comprises:

a mounting plate attached to said elongated member first end;

an axle element projecting from said mounting plate;

a stopper washer having an aperture that receives said axle element;

a hub bracket having an elongated aperture wherein said axle element extends through said elongated aperture and said rotatable arm's first end is secured to said hub bracket; and retention means for securing said hub bracket to said axle element and ii) first and second rotational motion stops secured within said hub assembly;

d) a ball secured to said rotatable arm second end; and e) means associated with said elongated member second end for anchoring said elongated member to the support.

5. A portable ball batting practice apparatus according to claim 4, wherein said first rotational motion stop comprises a projecting stop associated with said stopper washer and said second rotational motion stop comprises a projecting stop associated with said hub bracket.

* * * * *